US009443406B2

(12) United States Patent
Bradshaw et al.

(10) Patent No.: US 9,443,406 B2
(45) Date of Patent: Sep. 13, 2016

(54) DUAL MODE SECURITY TAGS

(71) Applicant: Checkpoint Systems, Inc., Thorofare, NJ (US)

(72) Inventors: Merril F. Bradshaw, Waxhaw, NC (US); Zachary Cody Hazelwood, Nashville, TN (US); Donald Matthew Johnson, Charlotte, NC (US); Brian R. Dobeck, Monroe, NC (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 0 days.

(21) Appl. No.: 14/575,889

(22) Filed: Dec. 18, 2014

(65) Prior Publication Data

US 2016/0180669 A1 Jun. 23, 2016

(51) Int. Cl.
*G08B 13/14* (2006.01)
*G08B 13/24* (2006.01)

(52) U.S. Cl.
CPC ..... *G08B 13/2402* (2013.01); *G08B 13/2448* (2013.01); *G08B 13/2462* (2013.01)

(58) Field of Classification Search
CPC ..... G06F 21/88; G01S 13/84; G01S 13/878; G08B 21/0202; G06K 7/10356; G06K 7/10039; G06K 7/0008; G06K 7/10079
USPC ..... 340/10.2, 568.1, 10.1, 8.1, 572.1, 340/573.1, 572.7, 539.26, 572.2, 10.3
See application file for complete search history.

(56) References Cited

U.S. PATENT DOCUMENTS 5,519,381 A * 5/1996 Marsh ..... A47F 9/048 340/10.2
5,949,335 A * 9/1999 Maynard ..... G06F 21/88 340/568.1
6,150,921 A * 11/2000 Werb ..... G01S 13/84 340/10.1
6,353,406 B1 * 3/2002 Lanzl ..... G01S 13/84 340/10.1
6,424,838 B1 * 7/2002 Stobbe ..... G01S 13/878 340/8.1

(Continued)

FOREIGN PATENT DOCUMENTS

EP 2747004 A1 6/2014

OTHER PUBLICATIONS

European Search Report and Written Opinion of corresponding application No. 15198510.8, mailed May 19, 2016, all enclosed pages cited.

*Primary Examiner* — Hoi Lau
(74) *Attorney, Agent, or Firm* — Nelson Mullins Riley & Scarborough, LLP

(57) ABSTRACT

A tag controller is configured to interface with a tag on a product in a monitoring environment that includes first and second monitoring zones. The first monitoring zone includes first locator devices, and the second monitoring zone includes second locator devices. The tag controller includes processing circuitry configured to facilitate operation of the tag in a first mode to employ wireless communication with the first locator devices or the second locator devices to generate position information usable for locating the tag in the monitoring environment. The first mode defines communication parameters associated with the wireless communication. The processing circuitry may also be configured to determine whether mode switch criteria are met, and direct the tag to switch to operation in a second mode to employ different communication parameters relative to wireless communication with the first locator devices or the second locator devices responsive to the mode switch criteria being met.

16 Claims, 6 Drawing Sheets

(56) References Cited

U.S. PATENT DOCUMENTS 6,963,270 B1 * 11/2005 Gallagher, III .... G06K 7/10039 340/10.2
7,199,710 B2 * 4/2007 Hiramitsu ..... B60R 25/245 235/435
7,323,991 B1 * 1/2008 Eckert ..... G07C 9/00111 235/382
8,487,769 B2 * 7/2013 Lindsay ..... G06K 19/0717 340/539.11
8,682,347 B2 * 3/2014 Hepo-Oja ..... G01S 1/14 340/13.26
8,711,046 B2 * 4/2014 Copeland ..... H01Q 1/2225 340/572.7
2002/0135479 A1 * 9/2002 Belcher ..... B60R 25/33 340/572.1
2003/0156026 A1 8/2003 Eagleson et al.
2004/0229560 A1 * 11/2004 Maloney ..... G07C 9/00087 455/3.01
2005/0073419 A1 * 4/2005 Gary, Jr. ..... G08B 21/0202 340/573.1
2005/0093679 A1 * 5/2005 Zai ..... G06K 7/10356 340/10.2
2007/0120650 A1 * 5/2007 Nagai ..... G06K 7/10356 340/10.2
2007/0178935 A1 * 8/2007 Shim ..... H04W 52/0235 455/552.1
2007/0241906 A1 * 10/2007 Malik ..... G06K 7/0008 340/572.7
2008/0061967 A1 * 3/2008 Corrado ..... G06K 7/10079 340/539.26
2008/0100446 A1 * 5/2008 Shintani ..... G06F 21/10 340/572.2
2008/0130604 A1 * 6/2008 Boyd ..... G01S 5/021 370/338
2009/0042561 A1 * 2/2009 Jackson ..... H04W 24/08 455/426.1
2009/0045923 A1 * 2/2009 van Eeden ..... G06K 7/0008 340/10.3
2009/0066516 A1 * 3/2009 Lazo ..... G06K 19/0724 340/572.7
2009/0253427 A1 * 10/2009 Fukushima ..... H04W 4/02 455/432.1
2010/0148931 A1 * 6/2010 Pappu ..... G06K 7/0008 340/10.2
2010/0277284 A1 * 11/2010 Brown ..... G06K 7/0008 340/10.3
2011/0068906 A1 * 3/2011 Shafer ..... G06K 7/0008 340/10.3
2011/0072132 A1 * 3/2011 Shafer ..... G06Q 10/087 709/224
2011/0080264 A1 4/2011 Clare et al.
2011/0116794 A1 * 5/2011 George ..... H04B 10/25754 398/45
2011/0121973 A1 * 5/2011 Yang ..... E05B 45/005 340/572.8
2012/0019363 A1 * 1/2012 Fein ..... G06K 19/072 340/10.1
2012/0025973 A1 * 2/2012 Derks ..... G01S 5/02 340/539.13
2012/0025980 A1 * 2/2012 Derks ..... G07C 9/00111 340/539.32
2012/0112906 A1 * 5/2012 Borke ..... G06F 19/327 340/539.13
2012/0119883 A1 * 5/2012 Bekritsky ..... G06K 7/10356 340/10.4
2012/0139724 A1 * 6/2012 Keinanen ..... G01S 1/14 340/539.13
2014/0043163 A1 * 2/2014 Yang ..... E05B 73/0017 340/572.1
2014/0197989 A1 * 7/2014 Hepo-Oja ..... G01S 1/14 342/386

* cited by examiner

DUAL MODE SECURITY TAGS

TECHNICAL FIELD

Various example embodiments relate generally to retail theft deterrent and merchandise protection devices and methods.

BACKGROUND

Security devices have continued to evolve over time to improve the functional capabilities and reduce the cost of such devices. Some security devices are currently provided to be attached to individual products or objects in order to deter or prevent theft of such products or objects. In some cases, the security devices include tags or other such components that can be detected by gate devices at the exit of a retail establishment. These gate devices may be sometimes referred to as towers or pedestals. When the security device passes through or proximate to the gates, an alarm or other notification locally at the product and/or at the gates may be triggered. Additionally, a key may be provided at the point of sale terminal so that the security device can be removed when the corresponding products or objects are purchased.

In order to improve the ability of retailers to deter theft, the security devices and systems in which they operate are continuously being improved. For example, various improvements may be introduced to attempt to improve location accuracy or to carry out certain specific desired functions. However, it may be difficult to determine the appropriate balance of characteristics for a given system.

BRIEF SUMMARY OF SOME EXAMPLES

Some example embodiments may provide tags that are configurable to operate in at least two different modes so that the system can be flexibly configured based on different considerations. Thus, for example, the tags may shift modes based on location or temporal characteristics. The modes may have different performance criteria and corresponding different strengths and weaknesses that can be helpful in different situations. Accordingly, the location of the tag or time may be used as a differentiator to place the tags in the desired mode of operation.

In one example embodiment, a tag controller that may be configured to interface with a security tag adapted to be disposed on a product in a monitoring environment is provided. The monitoring environment may include a first monitoring zone and a second monitoring zone. The first monitoring zone may include first locator devices associated with a first locating system, and the second monitoring zone may include second locator devices associated with a second locating system. The tag controller may include processing circuitry configured to facilitate operation of the security tag in a first mode to employ wireless communication with the first locator devices or the second locator devices to generate position information usable for locating the security tag in the monitoring environment. The first mode may define communication parameters associated with the wireless communication. The processing circuitry may also be configured to determine whether mode switch criteria are met, and direct the security tag to switch to operation in a second mode to employ different communication parameters relative to wireless communication with the first locator devices or the second locator devices responsive to the mode switch criteria being met.

According to another example embodiment, a security system is provided. The security system may include a security tag disposed on a product in a monitoring environment and a system controller. The monitoring environment may include a first monitoring zone including first locator devices associated with a first locating system and a second monitoring zone including second locator devices associated with a second locating system. The system controller may be configured to interface with the first locator devices and the second locator devices. At least one of the security tag or the system controller may include a tag controller comprising processing circuitry configured to facilitate operation of the security tag in a first mode to employ wireless communication with the first locator devices or the second locator devices to generate position information usable for locating the security tag in the monitoring environment. The first mode may define communication parameters associated with the wireless communication. The processing circuitry may also be configured to determine whether mode switch criteria are met, and direct the security tag to switch to operation in a second mode to employ different communication parameters relative to wireless communication with the first locator devices or the second locator devices responsive to the mode switch criteria being met.

BRIEF DESCRIPTION OF THE SEVERAL VIEWS OF THE DRAWING(S)

Having thus described some example embodiments of the invention in general terms, reference will now be made to the accompanying drawings, which are not necessarily drawn to scale, and wherein:

DETAILED DESCRIPTION

Figure 1:
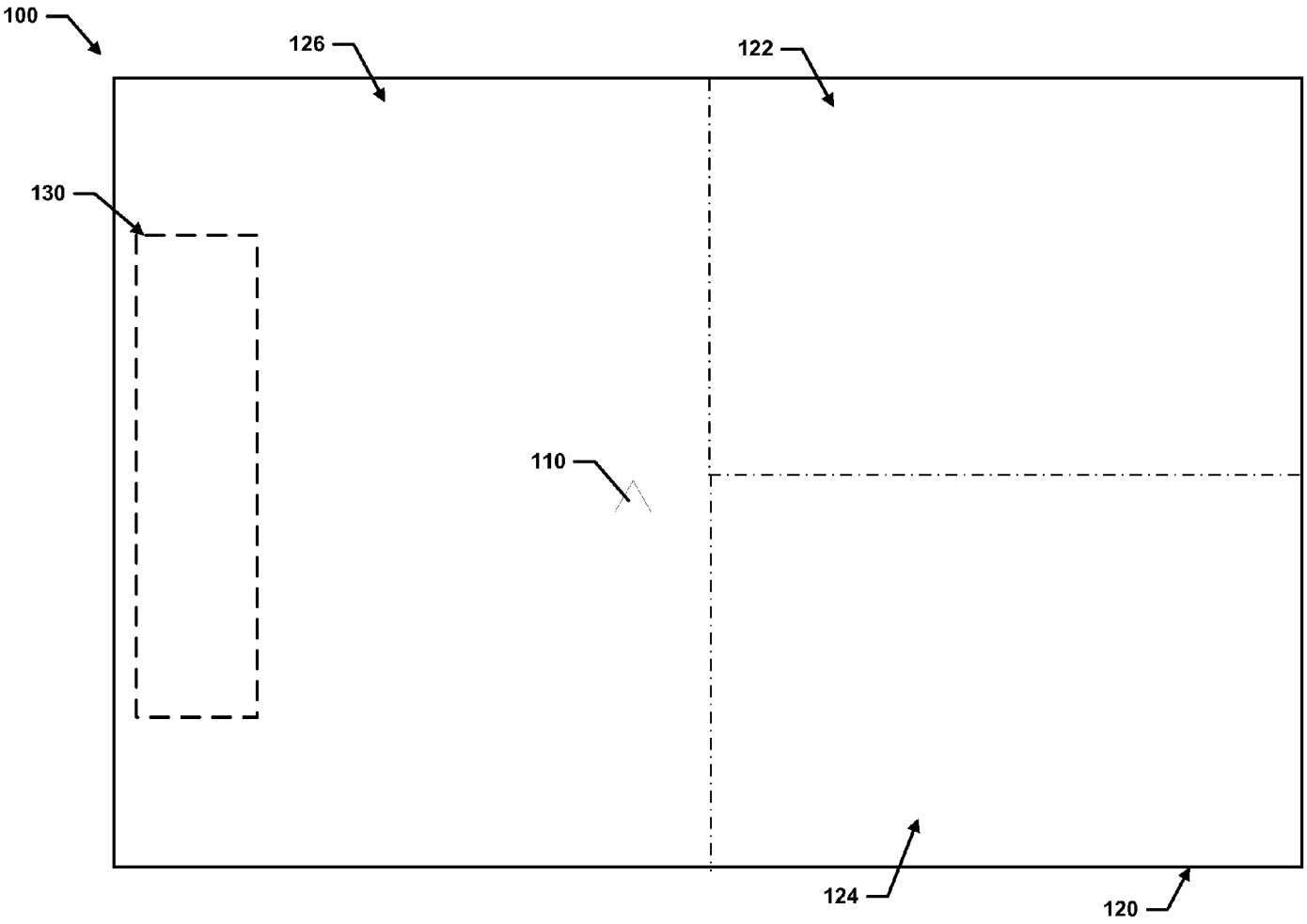
FIG. 1 illustrates a conceptual diagram of a monitoring environment within a retail store according to an example embodiment.

Some example embodiments now will be described more fully hereinafter with reference to the accompanying drawings, in which some, but not all embodiments are shown. Indeed, the examples described and pictured herein should not be construed as being limiting as to the scope, applicability or configuration of the present disclosure. Like reference numerals refer to like elements throughout. Furthermore, as used herein, the term "or" is to be interpreted as a logical operator that results in true whenever one or more of its operands are true. As used herein, "operable coupling" should be understood to relate to direct or indirect connection that, in either case, enables at least a functional interconnection of components that are operably coupled to each other.

Some example embodiments may enable provision of a network capable of allowing security devices (e.g., tags) to be attached to products, and further allow the mode of operation of the tags to be changed on the basis of various time or location based criteria. By enabling the tags to shift modes of operation, a more flexible and capable tracking system may be provided.

An example embodiment will be described herein as it relates to a security device (e.g., a tag) that can be attached to an object (e.g., a retail product) and wirelessly communicate with components of an anti-theft asset monitoring network. The network components and the tags may be configured to communicate with each other via any of a number of different communication schemes. Some of these schemes may only monitor for tags in an area proximate to an exit of the retail store being protected. Other schemes may monitor tags throughout the retail store or in various specific zones that may be defined. Furthermore, some embodiments may employ more than one communication scheme simultaneously or in a manner that allows switching between such communication schemes. Since this represents the most complex communication paradigm in which an example embodiment is likely to be practiced, an example monitoring environment will be described that employs more than one communication scheme.

Figure 2:
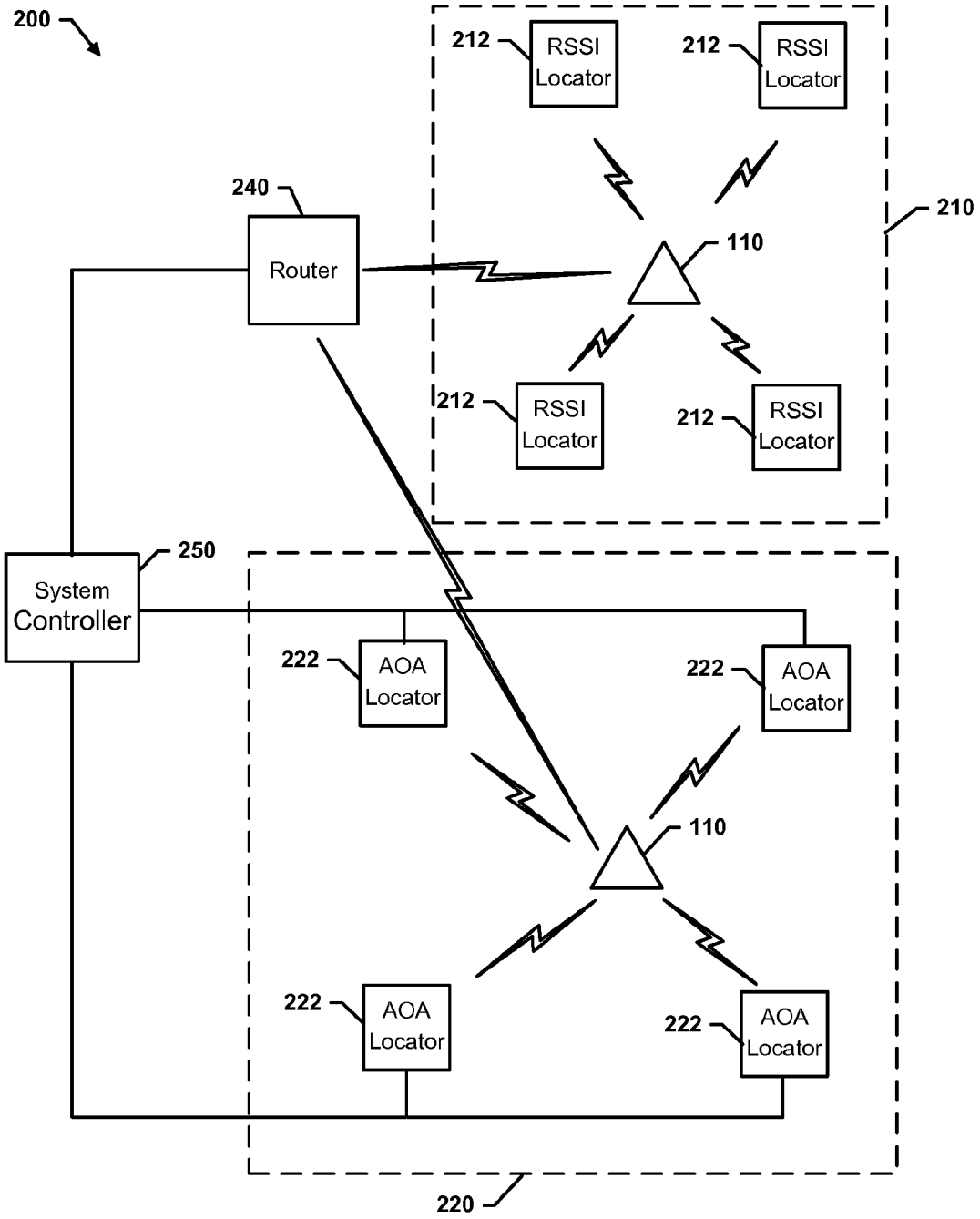
FIG. 2 illustrates a block diagram of a monitoring network that may be employed to monitor tags that may be placed on objects (products) in the monitoring environment in accordance with an example embodiment.

FIG. 1 illustrates a conceptual diagram of a monitoring environment 100 within a retail store. FIG. 2 illustrates a block diagram of a monitoring network 200 that may be employed to monitor tags 110 that may be placed on objects (products) in the monitoring environment 100 in accordance with an example embodiment. As shown in FIG. 1, the monitoring environment 100 may include a first monitoring zone 120 and a second monitoring zone 130. The first monitoring zone 120 may represent a relatively large area of the store (e.g., the sales floor). The second monitoring zone 130 may represent a smaller area of the store and, in some cases, may be proximate to the exit of the store. The first and second monitoring zones 120 and 130 may be exclusively defined or, in some embodiments, the second monitoring zone 130 may exist within and overlap with the first monitoring zone 120.

In some embodiments, the monitoring zones may be further divided into sub-zones. For example, as shown in FIG. 1, the first monitoring zone 120 may be divided into a first sub-zone 122, a second sub-zone 124 and a third sub-zone 126. In some cases, the sub-zones may be correlated with specific departments, locations or product lines within the store. However, the sub-zones could alternatively be defined to divide the monitoring environment 100 into conveniently defined regions to facilitate locating tags 110 within particular regions and detect movement within, out of, or into such regions. In some cases, the sub-zones may be defined at least in part based on proximity to the exit and/or to the second monitoring zone 130. Combinations of the above-described ways of defining sub-zones may also be employed.

In some cases, the second monitoring zone 130 may employ a more accurate and/or sensitive locating technique than the locating technique employed in the first monitoring zone 120. Although the first monitoring zone 120 may sometimes employ a less accurate or sensitive locating technique than the second monitoring zone 130, in some situations, the sub-zones of the first monitoring zone 120 may employ different levels of sensitivity (e.g., using higher or lower sample rates) in different sub-zones. For example, the third sub-zone 126, which is closer to the second monitoring zone 130 and the exit, may employ a higher sample rate for improved accuracy and sensitivity relative to the sample rate employed in the first and second sub-zones 122 and 124. Accordingly, as a product moves closer to the exit, the sensitivity to detection of the location of the product may increase.

The monitoring network 200 may include a first locating system 210 and a second locating system 220. Each of the first locating system 210 and the second locating system 220 may employ differing techniques for locating a tag 110 and may utilize a corresponding different hardware suite and communication paradigm. In an example embodiment, the first locating system 210 may be a locating system that employs received signal strength indication (RSSI) technology for locating the tags 110. Meanwhile, the second locating system 220 may employ angle of arrival (AOA) technology or other locating techniques, such as time of arrival (TOA), time differential of arrival (TDOA), or other techniques where a tag 110 sends a beacon signal to be listened for by an array of receivers to locate the tags 110. For example, AOA technology may employ receivers or AOA locators 222 including antenna arrays that listen for beacon packets, sent from the tags 110, having the correct format, and then process the packets to determine an angle of arrival of the packet relative to the receiver and the antenna array position. The active area of measurement may be relative to the center point of the antenna. Angle data may be calculated using peaks of angle curves generated based on beacon signals received in the active sensing area of the antennas of the array.

Further, for locating via AOA technology, the tags 110 may be configured to act as beacon devices sending out signals to be detected by AOA locators 222. The AOA locators 222, which may be configured as a patch antenna array (e.g., with 4 antennas) with each of the AOA locators 222 being disposed, for example, at or near corners of the second monitoring zone 130 (or the third sub-zone 126). Generally speaking, in the RSSI system (e.g., the first locating system 210), the tags 110 may be configured to act as listening devices to receive beacon signals transmitted from RSSI locators 212. Based on the signal strengths of the signals received from each of the RSSI locators 212, the position of the tag 110 relative to the RSSI locators 212 may be determined.

While the first locating system 210 and the second locating system 200 are described as employing different techniques for determining the location of a tag 110 (i.e., RSSI, AOA, TOA, TDOA, etc.), it is understood that, according to some example embodiments, the same technique could be used in both systems, however with different parameters between the systems. For example, the first locating system 210 may employ TDOA a lower sample rate than the second locating system 220 also employing TDOA.

In some embodiments, the second locating system 220 may be used to implement a gate solution for monitoring the exit of the store. Thus, for example, the second locating system 220 may be employed in the second monitoring zone 130. However, the second locating system 220 could also or alternatively be employed for an accurate (or at least more accurate) inventory zone inside which more accurate monitoring of tag 110 movement may be accomplished. Thus, for example, the second locating system 220 may be employed in the third sub-zone 126 to increase sensitivity to tag 110 location as the tag 110 moves closer to the exit. Moreover, the second locating system 220 may have low sample rate and high sample rate operational capabilities such that, for example, low rate AOA locating may be performed in the third sub-zone 126 and high rate AOA locating may be performed in the second monitoring zone 130. Finally, the first and/or second locating system 210 and 220 may be used for general tag 110 location determination with varying levels of accuracy dependent upon the locating technology used and the sample rate employed.

In some embodiments, since both the first and second locating systems 210 and 220 may be employed proximate to each other or even in the same area, the tags 110 may be configured to communicate with either or both of the first and second locating systems 210 and 220. In some cases, the second (e.g., AOA) and the first (e.g., RSSI) systems may be supported by employing an interleaved sample window. As such, for example, the tags 110 may be configured to read or listen for beacon signals transmitted from RSSI locators 212 every 500 msec. Thus, the RSSI sample rate may be half a second. Meanwhile, the RSSI locators 212 may be configured to beacon at a higher rate. The tags 110 may also be configured to beacon themselves with a 500 msec low rate beacon time with 20 msec slot times that are able to be changed to 160 msec high rate beaconing time to support, for example, AOA locating. This can provide a relatively large number of time slots (e.g., 25) that can be divided between high rate and low rate sampling via AOA, while also being interleaved with RSSI sampling. The specific details of locating system communication frequencies, sampling rates, and location determination algorithms may change in various different embodiments. Thus, the description above should be appreciated as merely one example implementation that may be employed in some contexts.

In an example embodiment, the number of tags that can be tracked or monitored may depend on the number of samples needed for required or desired accuracy and a desired hit rate for a given operational scenario. Different tracking requirements may be prescribed for various zones, sub-zones and/or the like based on the needs or desires of the retailer. Thus, for example, an alarm zone, an approach zone and other inventory tracking zones may be defined and different sample rates and/or other system characteristics may be defined in each zone. Meanwhile, in each zone, the tags 110 may be trackable using either or both of the first locating system 210 and the second locating system 220.

In some example embodiments, regardless of the type of systems that are being employed, a tag 110 may be configured to operate in a low power mode where the tag is asleep and wakes up to check in with the network, for example via system controller 250, at relatively large intervals (e.g., every 30 minutes). Movement of the tag 110 (e.g., as detected local to the tag via an accelerometer or jiggle switch) may cause the tag 110 to wake up, leave the low power mode to enter an active mode, and initiate communication with the system controller 250 at shorter intervals such as every half second (e.g., using the 500 msec sample window). According to some example embodiments, the tag 110 may be configured to send a motion start message to the system controller 250 to inform the system controller 250 that the tag has locally detected motion and that the tag will now be communicating at shorter intervals. The system controller 250 may track movement of the tag 110 after the motion start message is received and either update the position of the tag 110 (e.g., on a display or in a database or position log) or perform some other function based on the position of the tag 110 (e.g., inform staff of the tag location, generate an alarm or notification, etc.). When the tag 110 stops moving for a predetermined period of time (e.g., a local timer may be employed that resets in response to actuation of the jiggle switch or the like), a motion end message may be sent to the system controller 250 and, in some cases, the tag 110 may shift back to a low power mode.

As shown in FIG. 2, a plurality of the RSSI locators 212 may be positioned in corresponding zones that are to be monitored using RSSI. For example, the RSSI locators 212 may be positioned at corners or boundaries of the zones. In some example embodiments, the RSSI locators 212 could also be located within zones and the boundaries of the zones may be defined based on a predefined distance from one or more of the RSSI locators 212. The tags 110 may receive transmissions from the RSSI locators 212 and communicate information indicative of a location determined based on signal strength or signal strength data to be used to determine location through a router 240 to a system controller 250. The system controller 250 may, for example, be a computer, server or other terminal that may host software and/or hardware configurable to transform the data indicative of physical location of the tags 110 and the objects to which they are attached into trackable items that may be used to trigger various theft deterrent functions as described herein.

In some example embodiments, the system controller 250 may also be in communication with the AOA locators 222. The AOA locators 222 may be disposed within or around boundaries of the zone monitored via the second locating system 220 in a similar manner to the disposal of the RSSI locators 212 described above, or in a number of other configurations. However, the AOA locators 222 may listen for beacon signals instead of transmitting any beaconing signals. Thus, when the tags 110 are transmitting beacon signals for operation to the second locating system 220, the AOA locators 222 may each determine angle information indicative of the angle of the tag 110 relative to the corresponding AOA locator 222, or more specifically, the antennas of the AO locator 222 (or provide such information to the system controller 250 as is needed to enable the system controller 250 to determine the angle information). An estimated tag location may then be determined (e.g., via analysis of the angle information or via triangulation) by the system controller 250.

Figure 3:
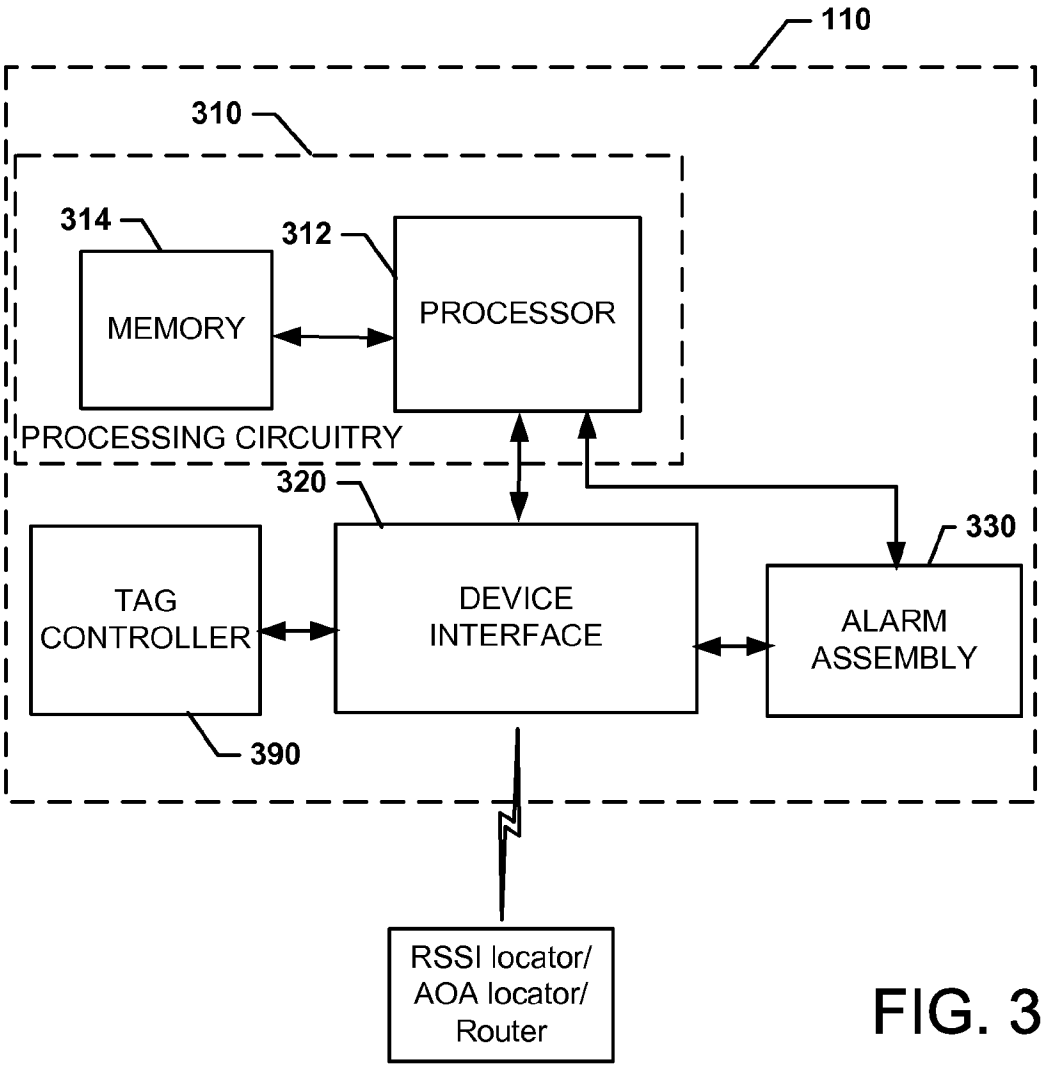
FIG. 3 illustrates a block diagram of a tag according to an example embodiment.
Figure 4:
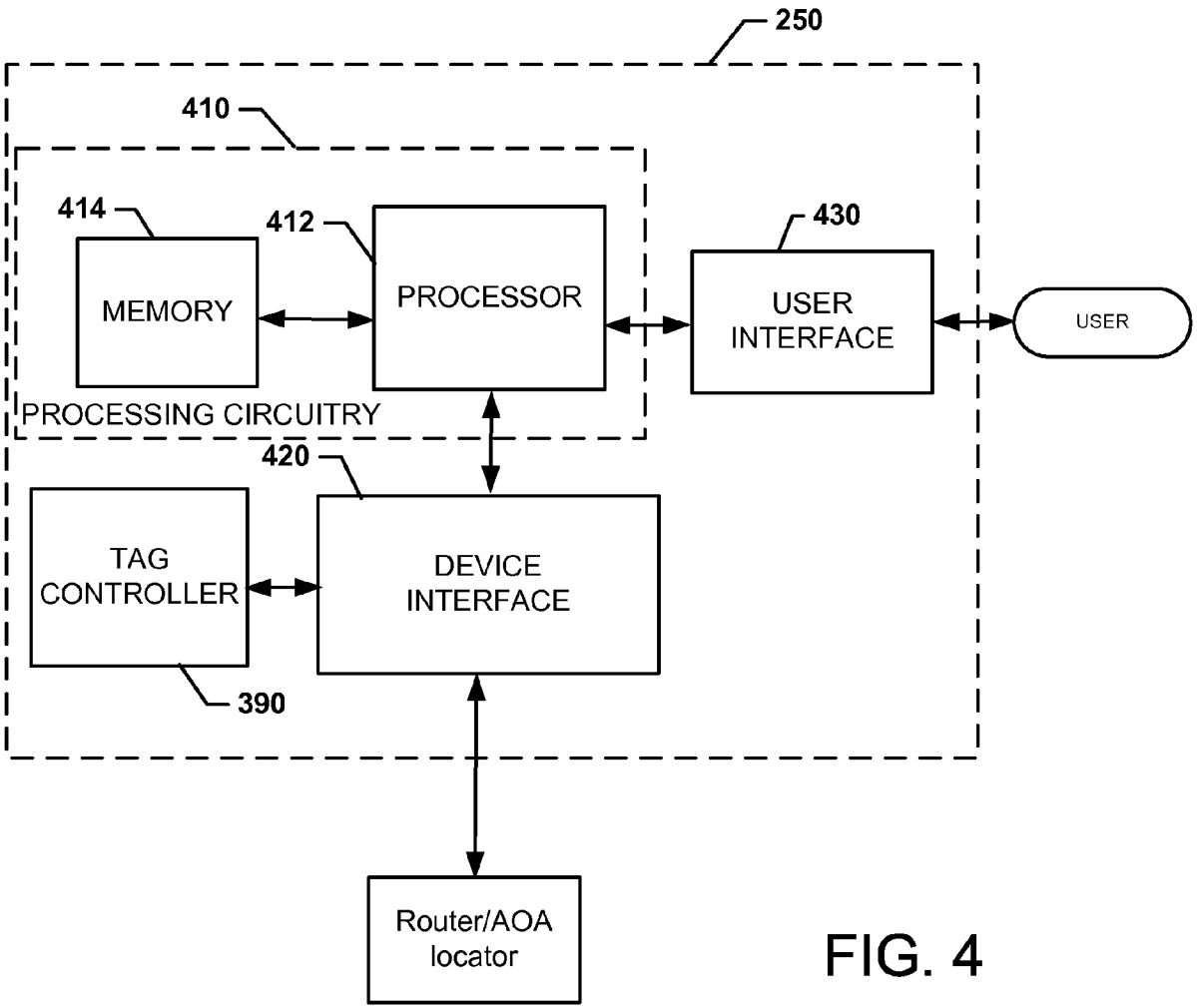
FIG. 4 illustrates a block diagram of a system controller according to an example embodiment.

FIG. 3 illustrates a block diagram of tag circuitry in accordance with an example embodiment. As shown in FIG. 4, the tag 110 may include processing circuitry 310 configured in accordance with an example embodiment as described herein. In this regard, for example, the tag 110 may utilize the processing circuitry 310 to provide electronic control inputs to one or more functional units (which may be implemented by or with the assistance of the of the processing circuitry 310) of the tag 110 to receive, transmit and/or process data associated with the one or more functional units and perform communications necessary to enable tracking of tags, issuing of alarms and/or alerts and/or the like as described herein.

In some embodiments, the processing circuitry 310 may be embodied as a chip or chip set. In other words, the processing circuitry 310 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 310 may therefore, in some cases, be configured to implement an embodiment of the present invention on a single chip or as a single "system on a chip." As such, in some cases, a chip or chipset may constitute means for performing one or more operations for providing the functionalities described herein.

In an example embodiment, the processing circuitry 310 may include one or more instances of a processor 312 and memory 314 that may be in communication with or otherwise control a device interface 320. As such, the processing circuitry 310 may be embodied as a circuit chip (e.g., an integrated circuit chip) configured (e.g., with hardware, software or a combination of hardware and software) to perform operations described herein.

The device interface 320 may include one or more interface mechanisms for enabling communication with other devices (e.g., RSSI locators 212, AOA locators 222, routers 240, other tags 110, tag readers, and/or other devices). In some cases, the device interface 320 may be any means such as a device or circuitry embodied in either hardware, or a combination of hardware and software that is configured to receive and/or transmit data from/to devices or components in communication with the processing circuitry 310 via internal and/or external communication mechanisms. Accordingly, for example, the device interface 320 may further include wireless communication equipment (e.g., one or more antennas) for at least communicating with RSSI locators 212, AOA locators 222, and/or routers 240. The device interface 320 may therefore include one or more antenna arrays that may be configured or configurable to receive and/or transmit properly formatted signals associated with at least the first locating system 210 and the second locating system 220. The device interface 320 may further include radio circuitry configured to encode and/or decode, modulate and/or demodulate, or otherwise process wireless signals received by or to be transmitted by the antenna array(s).

In some embodiments, the tag 110 may also include an alarm assembly 330, which may include an audio device (e.g., a piezoelectric, mechanical, or electromechanical beeper, buzzer or other audio signaling device such as an audible alarm). The alarm assembly 330 may include a speaker or other sound generating device that may be provided in a housing of the tag 110. In some example embodiments, the alarm assembly 330 may also include visible indicia (e.g., lights of one or more colors such as a bi-color (e.g., red/green) LED). The visible indicia of the alarm assembly 330 and/or the audio device thereof may be used in various ways to facilitate or enhance operation of the tag 110. For example, different tones, sounds, or music may be played when the tag 110 receives different messages, or is operated in a certain way (e.g., movement into or out of a particular zone, proximity to a gate, passage through the gate, loss of communication with the network, detection of tampering or cutting of wires that affixed the tag 110 to an object, etc.). Similarly, different light colors, light flash sequences or other visible indicia may be provided in combination with or instead of the audible indicia in order to indicate certain conditions (e.g., movement into or out of a particular zone, proximity to a gate, passage through the gate, loss of communication with the network, detection of tampering or cutting of wires that affixed the tag 110 to an object, etc.).

The processor 312 may be embodied in a number of different ways. For example, the processor 312 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 312 may be configured to execute instructions stored in the memory 314 or otherwise accessible to the processor 312. As such, whether configured by hardware or by a combination of hardware and software, the processor 312 may represent a physical entity (e.g., physically embodied in circuitry—in the form of processing circuitry 310) capable of performing operations according to example embodiments while configured accordingly. Thus, for example, when the processor 312 is embodied as an ASIC, FPGA or the like, the processor 312 may be specifically configured hardware for conducting the operations described herein. Alternatively, as another example, when the processor 312 is embodied as an executor of software instructions, the instructions may specifically configure the processor 312 to perform the operations described herein in reference to execution of an example embodiment.

In some examples, the processor 312 (or the processing circuitry 310) may be embodied as, include or otherwise control the operation of the tag 110 based on inputs received by the processing circuitry 310. As such, in some embodiments, the processor 312 (or the processing circuitry 310) may be said to cause each of the operations described in connection with the tag 110 to occur in relation to operation of the tag 110 relative to undertaking the corresponding functionalities associated therewith responsive to execution of instructions or algorithms configuring the processor 312 (or processing circuitry 310) accordingly. In particular, the processor 312 (or processing circuitry 310) may be configured to enable the tag 110 to communicate with the RSSI locators 212, AOA locators 222, and/or routers 240 to provide information to the system controller 250 that enables the system controller 250 to locate the tag and, in some cases, perform other functions based on the location of the tag 110 or other information about the status of the tag 110 that is determinable from the communications with the tag 110 (or lack thereof).

In an example embodiment, the memory 314 may include one or more non-transitory memory devices such as, for example, volatile and/or non-volatile memory that may be either fixed or removable. The memory 314 may be configured to store information, data, applications, instructions or the like for enabling the processing circuitry 310 to carry out various functions in accordance with example embodiments. For example, the memory 314 may be configured to buffer input data for processing by the processor 312. Additionally or alternatively, the memory 314 may be configured to store instructions for execution by the processor 312. As yet another alternative or additional capability, the memory 314 may include one or more databases that may store a variety of data sets or tables useful for operation of the tag 110. Among the contents of the memory 314, applications or instruction sets may be stored for execution by the processor 312 in order to carry out the functionality associated with each respective application or instruction set. In some cases, the applications/instruction sets may include instructions for carrying out some or all of the operations described in reference to the algorithms or flow charts described herein. In particular, the memory 314 may store executable instructions that enable the computational power of the processing circuitry 310 to be employed to improve the functioning of the tag 110 relative to the tracking, notifying and alarming functions described herein. As such, the improved operation of the computational components of the tag 110 transforms the tag 110 into a more capable tracking, notifying and alarming device relative to the physical objects to which the tag 110 is attached. In particular, the tag 110 may be transformed into a multi mode tag (e.g., at least including dual mode operation) that is capable of operating in different modes with corresponding different communication characteristics that can be optimized based on time and/or location.

To accomplish the multi-modal functionality of the tag 110, a tag controller 390 may be provided. In some cases, the tag controller 390 may be embodied at the tag 110. However, as will be seen below, the tag controller 390 could alternatively be embodied at the system controller 250 or may be distributed between the tag 110 and the system controller 250, or other components of the first or second locating systems 210 and 220. The tag controller 390 may therefore be any means or device embodied in hardware, software or a combination of hardware and software that may be configured to direct operation of the tag 110 at least with respect to the multi-modal operations described herein. The tag controller 390 may therefore be controlled by the processing circuitry 310 or even may be embodied by the processing circuitry 310. In any case, the processing circuitry 310 may be said to cause the operations of the tag controller 390 at least with respect to portions of the tag controller 390 that are embodied at the tag 110.

In an example embodiment, the tag controller 390 may be configured to facilitate operation of the security tag in a first mode initially, and to facilitate deciding whether (and when) to switch to a different mode (i.e., a second mode). The first mode and second mode may each be corresponding different operational modes that are differentiated from each other on the basis of employing different communication parameters. In some cases, the different communication parameters may be associated with enabling communication with corresponding different locating systems. As such, for example, the mode shift from the first mode to the second mode may include shifting from communicating with the first locating system 210 to communicating with the second locating system 220 (or vice versa). As such, the tag controller 390 may direct the tag 110 to switch between RSSI and AOA methods of locating and thereby also switch between listening for beacons signals and transmitting beacon signals. However, the mode switch need not necessarily involve switching between locating systems. In fact, in some cases, the mode shift may merely involve changing the sample rate for communication within a given one of the locating systems. For example, the mode switch may include shifting between a high rate AOA locating communication paradigm to a low rate AOA locating communication paradigm. That said, in some cases, the sample rates may also be different between the first locating system 210 and the second locating system 220, so a mode switch involving a rate change may also involve a locating system change and a corresponding shift between sending and receiving beacon signals.

In some embodiments, the tag controller 390 may facilitate communication in the first mode or the second mode by taking an active role in communications associated with such modes in terms of directing tag functionality. However, in other cases, the tag controller 390 may facilitate communication in such modes only by virtue of not shifting out of a current mode or directing a shift to another mode. Thus, the tag controller 390 may have various levels of involvement in tag activity with respect to the facilitation of the communications described herein.

In an example embodiment, while the tag 110 operates in an initial mode (e.g., the first mode), the tag 110 may employ wireless communication with the RSSI locators 212 or AOA locators 222 to generate position information usable for locating the tag 110 in the monitoring environment 100. As such, for example, the location of the tag 110 relative to boundaries of the monitoring zones and/or sub-zones, or with specific coordinates within such zones and/or sub-zones may be determined. In some cases, the location may be recorded within a location table that may be stored in the memory 314 along with an indication of the corresponding locating system via which the location was determined at a corresponding time. At any given time, the location may be recorded in association with one locating system, and the tag controller 390 may compare the location and/or time to mode switch criteria that may be used to determine whether to switch operating modes. Thus, the basis for switching operating modes could be the current time and/or the location of the tag 110. The tag controller 390 may therefore be configured with predefined mode switch criteria that define conditions which when sensed by the tag controller 390 (or other components communicating with the tag controller 390) cause the tag controller 390 to initiate a mode switch. The initiation of the mode switch may include taking local action to initiate usage of new communication parameters (e.g., to use a different locating system or different sample rate) or directing local tag components to take such action (e.g., via the processing circuitry 310). As such, the tag controller 390 may direct the tag 110 to switch to operation in the second mode and thereby employ different communication parameters relative to wireless communication with the RSSI locators 212 or AOA locators 222 responsive to the mode switch criteria being met.

In some cases, determinations regarding whether the mode switch criteria are met may be based on movements between the first monitoring zone 120 and the second monitoring zone 130 and/or any sub-zones thereof. These movements may be determined based on grid locations or general areas that are known and may or may not had defined borders therebetween. Where borders are defined, the movement across a border may trigger mode switch if such border is included as mode switch criteria. In some cases, tag movement may be considered to generate location vectors that indicate position and direction and speed of motion. Thus, if the current position and direction and speed of motion of the tag 110 indicates that a border will be crossed at a given time in the near future (e.g., within a threshold amount of time in the future), then the tag controller 390 may use the location vector to initiate a mode switch if the corresponding border is included as mode switch criteria.

As an example of location based mode switching, sections of the store that are farthest from the exit (e.g., the first sub-zone 122) may employ RSSI, and sections closer to the exit (e.g., the third sub-zone 126 and second monitoring zone 130) may employ AOA. However, the second monitoring zone 130 may require more sensitivity since it may act as a security gate area. Thus, for example, the second monitoring zone 130 may employ a high rate AOA while the third sub-zone 126 may employ a lower rate AOA. Detected movement between each respective zone or sub-zone may therefore trigger the corresponding mode switches between RSSI and high/low rate AOA. Accordingly, example embodiments may essentially enable (via the tag controller 390) switching between at least two different operational modes (and sometimes two different locating systems) based on a location detected via either of the operational modes (and locating systems).

In embodiments in which temporal considerations are used as mode switch criteria, one or more time ranges may be defined and the time ranges may be correlated to respective operational modes that are to be employed in each time range. As such, to cause temporal based mode changes, current time may be compared to a mode schedule that defines an operational mode for each of the time ranges and the defined operational mode for the current time range may be maintained or otherwise switched to. For example, working hours or open hours (e.g., 9 AM to 9 PM) may correlate to operation in AOA and closed hours (e.g., 9 PM to 9 AM) may correlate to operation in a lower sensitivity mode (e.g., RSSI). However, rather than switching between RSSI and AOA, it should also be appreciated that switching may be conducted between operational modes such as RSSI and AOA in which tracking occurs in an interleaved half second sample window and non-tracking modes such as a sleep mode or battery conservation mode.

FIG. 4 illustrates a block diagram of the system controller 250 in accordance with an example embodiment. As shown in FIG. 4, the system controller 250 may include processing circuitry 410 of an example embodiment as described herein. In this regard, for example, the system controller 250 may utilize the processing circuitry 410 to provide electronic control inputs to one or more functional units of the system controller 250 to obtain, transmit and/or process data associated with the one or more functional units and perform the subsequent locating, tracking, notification, and/or alarm functions described herein. The system controller 250 may also initiate mode switching in some cases, as described below.

In some embodiments, the processing circuitry 410 may be embodied in physical and functional form in a similar manner to that which has been described above with respect to FIG. 3. However, according to some example embodiments, the processing circuitry 410 may have expanded capabilities with respect to processing speed and communication throughput relative to the processing circuitry utilized by the tag 110.

In an example embodiment, the processing circuitry 410 may include one or more instances of a processor 412 and memory 414 that may be in communication with or otherwise control a device interface 420 and, in some cases, a user interface 430. As such, the processing circuitry 410 may be embodied as a circuit chip (e.g., an integrated circuit chip) configured (e.g., with hardware, software or a combination of hardware and software) to perform operations described herein.

The user interface 430 may be in communication with the processing circuitry 410 to receive an indication of a user input at the user interface 430 and/or to provide an audible, visual, tactile or other output to the user. As such, the user interface 430 may include, for example, a touch screen, one or more switches, buttons or keys (e.g., function buttons), mouse, joystick, keyboard, and/or other input mechanisms. In an example embodiment, the user interface 430 may include one or a plurality of lights, a display, a speaker, a tone generator, a vibration unit and/or the like as potential output mechanisms.

The device interface 420 may include one or more interface mechanisms for enabling communication with other devices (e.g., AOA locators 222, routers 240 and/or external network devices). In some cases, the device interface 420 may be any means such as a device or circuitry embodied in either hardware, or a combination of hardware and software that is configured to receive and/or transmit data from/to devices or components in communication with the processing circuitry 410 via internal and/or external communication mechanisms. Accordingly, for example, the device interface 420 may further include Ethernet connections and/or wireless communication equipment for at least communicating with the AOA locators 222 and/or routers 240.

The processor 412 may be embodied in a number of different ways. For example, the processor 412 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 412 may be configured to execute instructions stored in the memory 414 or otherwise accessible to the processor 412. As such, whether configured by hardware or by a combination of hardware and software, the processor 412 may represent an entity (e.g., physically embodied in circuitry—in the form of processing circuitry 410) capable of performing operations according to embodiments of the present invention while configured accordingly. Thus, for example, when the processor 412 is embodied as an ASIC, FPGA or the like, the processor 412 may be specifically configured hardware for conducting the operations described herein. Alternatively, as another example, when the processor 412 is embodied as an executor of software instructions, the instructions may specifically configure the processor 412 to perform the operations described herein in reference to execution of an example embodiment.

In some examples, the processor 412 (or the processing circuitry 410) may be embodied as, include or otherwise control the operation of the system controller 250 based on inputs received by the processing circuitry 410. As such, in some embodiments, the processor 412 (or the processing circuitry 410) may be said to cause each of the operations described in connection with the system controller 250 in relation to operation of the system controller 250 relative to undertaking the corresponding functionalities associated therewith responsive to execution of instructions or algorithms configuring the processor 412 (or processing circuitry 410) accordingly. In particular, the processor 412 (or processing circuitry 410) may be configured to enable the system controller 250 to communicate with the AOA locators 222, and/or routers 240 to provide information to the system controller 250 that enables the system controller 250 to locate the tag 110 and, in some cases, perform other functions based on the location of the tag 110 or other information about the status of the tag 110 that is determinable from the communications with the tag 110 (or lack thereof).

In an exemplary embodiment, the memory 414 may include one or more non-transitory memory devices such as, for example, volatile and/or non-volatile memory that may be either fixed or removable. The memory 414 may be configured to store information, data, applications, instructions or the like for enabling the processing circuitry 410 to carry out various functions in accordance with exemplary embodiments of the present invention. For example, the memory 414 could be configured to buffer input data for processing by the processor 412. Additionally or alternatively, the memory 414 could be configured to store instructions for execution by the processor 412. As yet another alternative or additional capability, the memory 414 may include one or more databases that may store a variety of data sets or tables useful for operation of the system controller 250. Among the contents of the memory 414, applications or instruction sets may be stored for execution by the processor 412 in order to carry out the functionality associated with each respective application or instruction set. In some cases, the applications/instruction sets may include instructions for carrying out some or all of the operations described in reference to the algorithms or flow charts described herein. In particular, the memory 414 may store executable instructions that enable the computational power of the processing circuitry 410 to be employed to improve the functioning of the system controller 250 relative to the tracking, notifying and alarming functions described herein. As such, the improved operation of the computational components of the system controller 250 transforms the system controller 250 into a more capable tracking, notifying and alarming device relative to the physical objects to which the tag 110 is attached. The processing circuitry 410 may therefore be configured, e.g., by instruction execution, to receive signals from the tags (e.g., via the locators and/or the router 240) and transform attributes of the received signals into data describing the location of the tags 110 for presentation to a user on a terminal or to trigger other functionalities of the system. The processing circuitry 410 may also transform information indicative of the location of the tag 110 or time into functional inputs that can be compared to predefined criteria to cause mode shift instructions to be generated when the functional inputs match the predefined criteria. When operating in this capacity, an instance of the tag controller 390 may be provided at the system controller 250 either as an alternative to embodying the tag controller 390 at the tag 110 or as a distributed component that may integrate and operate in cooperation with a corresponding distributed component at the tag 110.

In an example embodiment, the system controller 250 may therefore be configured to receive information indicative of tag location and make decisions on mode switching as described above. However, in such examples, the location table and/or mode schedule may be stored at the memory 414. When the tag controller 390 is embodied at the system controller 250, the tag controller 390 may direct the tag 110 to shift modes by communicating instructions for mode shifting to the tag 110 via the router 240 or any other system component that may be configured to communicate with the tag 110.

Figure 5:
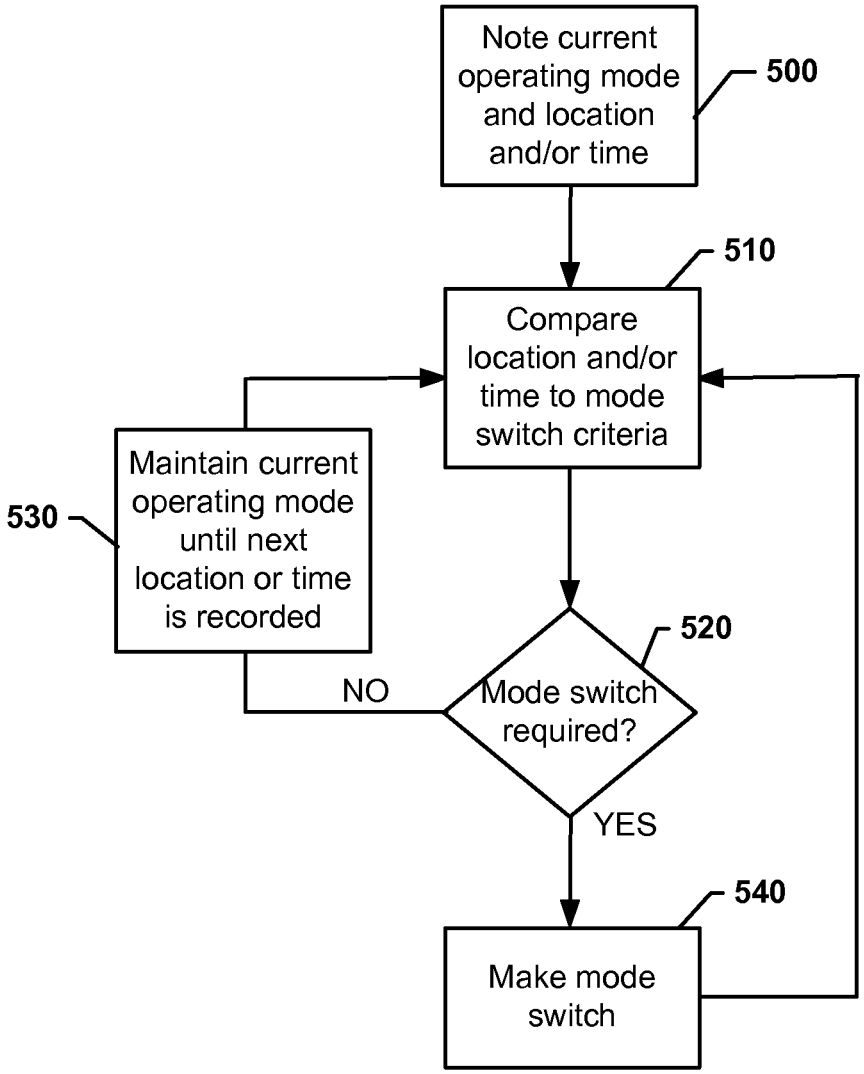
FIG. 5 illustrates a block diagram showing a control flow representative of an algorithm executable at a tag controller in accordance with an example embodiment.
Figure 6:
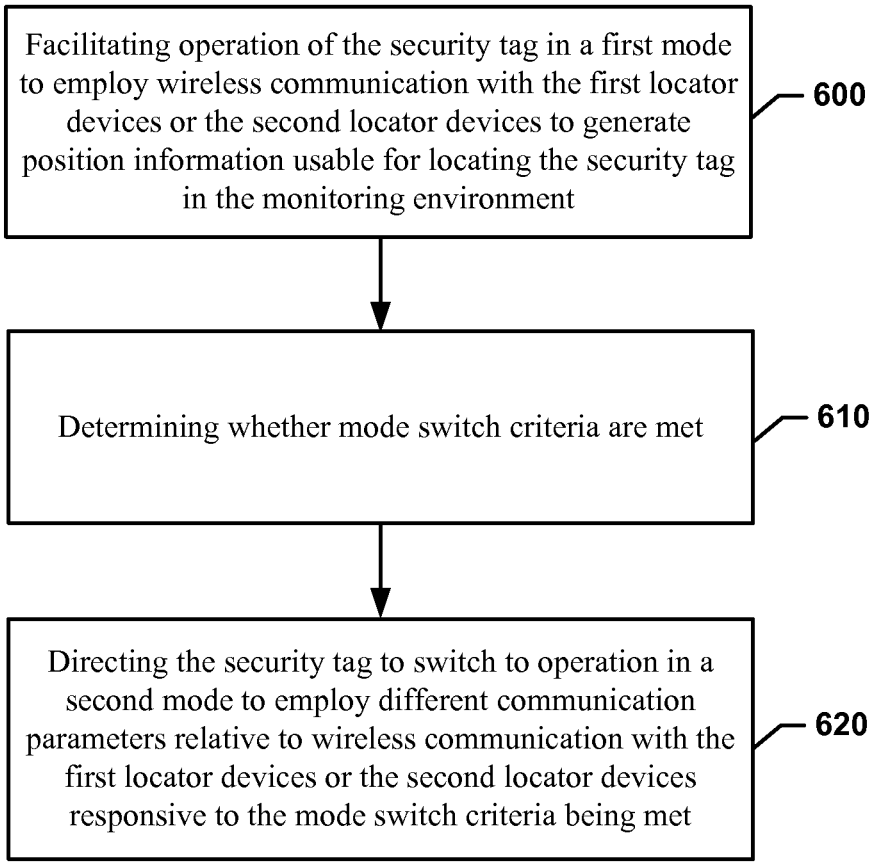
FIG. 6 illustrates a block diagram of a method of determining when a tag in a monitoring system should be shifted to a different operational mode in accordance with an example embodiment.

From a technical perspective, the tag controller 390 embodied at either or both of the system controller 250 and the tag 110 described above may be used to support some or all of the operations described above. As such, the platforms described in FIGS. 1-4 may be used to facilitate the implementation of several computer program and/or network communication based interactions. As an example, FIGS. 5 and 6 are flowcharts of example methods and program products according to an example embodiment. It will be understood that each block of the flowcharts, and combinations of blocks in the flowcharts, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device of a computing device and executed by a processor in the computing device. As will be appreciated, any such computer program instructions may be loaded onto a computer or other programmable apparatus (e.g., hardware) to produce a machine, such that the instructions which execute on the computer or other programmable apparatus create means for implementing the functions specified in the flowchart block(s). These computer program instructions may also be stored in a computer-readable memory that may direct a computer or other programmable apparatus to function in a particular manner, such that the instructions stored in the computer-readable memory produce an article of manufacture which implements the functions specified in the flowchart block(s). The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In this regard, FIG. 5 illustrates a block diagram showing a control flow representative of an algorithm executable at the tag controller 390 (e.g., at the system controller 250 or tag 110) in accordance with an example embodiment. As shown in FIG. 5, the tag controller 390 may initially note the current operating mode and location and/or time at operation 500. The tag controller 390 may extract all of this information from the location table, if the location table is employed. Thereafter, the tag controller 390 may compare the location and/or time (e.g., as recorded in the location table) to the mode switch criteria at operation 510. A determination may then be made at operation 520 as to whether the location requires a mode switch and/or whether the current time requires a mode switch relative to the current operating mode. If no mode switch is required, the current operating mode may be maintained at operation 530 until the next location or time is recorded at which time flow returns to operation 510. However, if the mode switch is required, then a mode switch will be initiated at operation 540 and flow will also return to operation 510 when the next location or time is recorded. Thus, for example, the tag controller 390 may continuously evaluate whether to change modes based on the current location of the tag 110 and/or the current time.

FIG. 6 illustrates a block diagram of a method of controlling multi-modal operation of a security device (e.g., a security tag) in accordance with an example embodiment. The method may be executed by a tag controller that may be configured to interface with the security tag either locally or remotely (e.g., from the system controller 250, router 240 and/or the locators). The tag controller may operate within a monitoring environment that may include at least a first monitoring zone and a second monitoring zone. The first monitoring zone may include first locator devices associated with a first locating system, and the second monitoring zone may include second locator devices associated with a second locating system. The tag controller may include processing circuitry configured to perform the method of FIG. 6. The method may include facilitating operation of the security tag in a first mode to employ wireless communication with the first locator devices or the second locator devices to generate position information usable for locating the security tag in the monitoring environment at operation 600. The first mode may define communication parameters associated with the wireless communication. The method may further include determining whether mode switch criteria are met at operation 610, and directing the security tag to switch to operation in a second mode to employ different communication parameters relative to wireless communication with the first locator devices or the second locator devices responsive to the mode switch criteria being met at operation 620.

In some embodiments, the features described above may be augmented or modified, or additional features may be added. These augmentations, modifications and additions may be optional and may be provided in any combination. Thus, although some example modifications, augmentations and additions are listed below, it should be appreciated that any of the modifications, augmentations and additions could be implemented individually or in combination with one or more, or even all of the other modifications, augmentations and additions that are listed. As such, for example, determining whether the mode switch criteria are met may include determining whether the mode switch criteria are met based on a determined location of the security tag. In some cases, determining whether the mode switch criteria are met based on the determined location of the security tag may include determining whether the security tag has moved between the first monitoring zone and the second monitoring zone. Alternatively or additionally, determining whether the mode switch criteria are met based on the determined location of the security tag may include determining proximity of the security tag to a border between the first monitoring zone and the second monitoring zone and determining that the mode switch criteria are met in response to a motion vector of the security tag indicating that the security tag is likely to cross the border. In an example embodiment, determining whether the mode switch criteria are met may include employing temporal mode switch criteria to determine whether the mode switch criteria are met as an alternative or in addition to using location based criteria. For example, current time may be compared to a mode schedule defining an operational mode for each of a plurality of ranges of time. In some embodiments, the first locating system includes first locators that transmit first beacon signals to the security tag such that tag position is determined based on signal strength measurements associated with detection of the security tag. The second locating system may include second locators that receive second beacon signals from the security tag such that tag position is determined based on an angle of arrival of the second beacon signals at the second locators. In an example embodiment, the security tag may be configured to receive beacon transmissions in the first mode and is configured to transmit beacon signals in the second mode. In some cases, the security tag may be configured to transmit beacon signals to the first or second locator devices at a first rate in the first mode, and transmit beacon signals to the first or second locator devices at a second rate in the second mode. In an example embodiment, the tag controller may be configured to lookup current security tag location in a location table and determine whether the mode switch criteria are met based on a correlation between predefined areas and a corresponding operational mode.

Example embodiments may provide a security device that can effectively protect a product to which it is attached from theft, while enabling the device to shift between different modes of operation based on either location or temporal criteria. By enabling the security device to shift modes of operation, the mode of operation may be tailored to time or location so that a single security device may provide different advantages under different conditions rather than requiring separate and different tracking systems and tags. Effectiveness and overall cost to a retailer using instances of the security device to protect products may therefore be reduced.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A tag controller configured to interface with a security tag adapted to be disposed on a product in a monitoring environment, the monitoring environment comprising a first monitoring zone and a second monitoring zone, the first monitoring zone including first locator devices associated with a first locating system, the second monitoring zone including second locator devices associated with a second locating system, the tag controller comprising processing circuitry configured to:

facilitate operation of the security tag in a first mode to employ wireless communication with the first locator devices or the second locator devices to generate position information usable for locating the security tag in the monitoring environment, the first mode defining communication parameters associated with the wireless communication;

determine whether mode switch criteria are met, wherein determining whether the mode switch criteria are met comprises employing temporal mode switch criteria; and direct the security tag to switch to operation in a second mode to employ different communication parameters relative to wireless communication with the first locator devices or the second locator devices responsive to the mode switch criteria being met, wherein the tag controller is further configured to compare a current time to a mode schedule defining an operational mode for each of a plurality of ranges of time.

2. The tag controller of claim 1, wherein determining whether the mode switch criteria are met further comprises determining whether the mode switch criteria are met based on a determined location of the security tag.

3. The tag controller of claim 2, wherein determining whether the mode switch criteria are met based on the determined location of the security tag comprises determining whether the security tag has moved between the first monitoring zone and the second monitoring zone.

4. The tag controller of claim 2, wherein determining whether the mode switch criteria are met based on the determined location of the security tag comprises determining proximity of the security tag to a border between the first monitoring zone and the second monitoring zone and determining that the mode switch criteria are met in response to a motion vector of the security tag indicating that the security tag is likely to cross the border.

5. A tag controller configured to interface with a security tag adapted to be disposed on a product in a monitoring environment, the monitoring environment comprising a first monitoring zone and a second monitoring zone, the first monitoring zone including first locator devices associated with a first locating system, the second monitoring zone including second locator devices associated with a second locating system, the tag controller comprising processing circuitry configured to:

facilitate operation of the security tag in a first mode to employ wireless communication with the first locator devices or the second locator devices to generate position information usable for locating the security tag in the monitoring environment, the first mode defining communication parameters associated with the wireless communication;

determine whether mode switch criteria are met; and direct the security tag to switch to operation in a second mode to employ different communication parameters relative to wireless communication with the first locator devices or the second locator devices responsive to the mode switch criteria being met, wherein the first locating system includes first locators that transmit first beacon signals to the security tag such that tag position is determined based on signal strength measurements associated with detection of the security tag, and wherein the second locating system includes second locators that receive second beacon signals from the security tag such that tag position is determined based on an angle of arrival of the second beacon signals at the second locators.

6. The tag controller of claim 5, wherein the security tag is configured to receive beacon transmissions in the first mode and is configured to transmit beacon signals in the second mode.

7. The tag controller of claim 5, wherein the security tag is configured to transmit the second beacon signals to the second locator devices at a first rate in the first mode, and wherein the security tag is configured to transmit the second beacon signals to the second locator devices at a second rate in the second mode.

8. The tag controller of claim 1, wherein the tag controller is configured to lookup current security tag location in a location table and determine whether the mode switch criteria are met based on a correlation between predefined areas and a corresponding operational mode.

9. A security system comprising:

a security tag disposed on a product in a monitoring environment;

a first monitoring zone including first locator devices associated with a first locating system;

a second monitoring zone including second locator devices associated with a second locating system; and a system controller configured to interface with the first locator devices and the second locator devices, wherein at least one of the security tag or the system controller includes a tag controller comprising processing circuitry configured to:

facilitate operation of the security tag in a first mode to employ wireless communication with the first locator devices or the second locator devices to generate position information usable for locating the security tag in the monitoring environment, the first mode defining communication parameters associated with the wireless communication;

determine whether mode switch criteria are met, wherein determining whether the mode switch criteria are met comprises employing temporal mode switch criteria; and direct the security tag to switch to operation in a second mode to employ different communication parameters relative to wireless communication with the first locator devices or the second locator devices responsive to the mode switch criteria being met, wherein the tag controller is configured to compare a current time to a mode schedule defining an operational mode for each of a plurality of ranges of time.

10. The security system of claim 9, wherein determining whether the mode switch criteria are met further comprises determining whether the mode switch criteria are met based on a determined location of the security tag.

11. The security system of claim 10, wherein determining whether the mode switch criteria are met based on the determined location of the security tag comprises determining whether the security tag has moved between the first monitoring zone and the second monitoring zone.

12. The security system of claim 10, wherein determining whether the mode switch criteria are met based on the determined location of the security tag comprises determining proximity of the security tag to a border between the first monitoring zone and the second monitoring zone and determining that the mode switch criteria are met in response to a motion vector of the security tag indicating that the security tag is likely to cross the border.

13. A security system comprising:

a security tag disposed on a product in a monitoring environment;

a first monitoring zone including first locator devices associated with a first locating system;

a second monitoring zone including second locator devices associated with a second locating system; and a system controller configured to interface with the first locator devices and the second locator devices, wherein at least one of the security tag or the system controller includes a tag controller comprising processing circuitry configured to:

facilitate operation of the security tag in a first mode to employ wireless communication with the first locator devices or the second locator devices to generate position information usable for locating the security tag in the monitoring environment, the first mode defining communication parameters associated with the wireless communication;

determine whether mode switch criteria are met; and direct the security tag to switch to operation in a second mode to employ different communication parameters relative to wireless communication with the first locator devices or the second locator devices responsive to the mode switch criteria being met, wherein the first locating system includes first locators that transmit first beacon signals to the security tag such that tag position is determined based on signal strength measurements associated with detection of the, and wherein the second locating system includes second locators that receive second beacon signals from the security tag such that tag position is determined based on an angle of arrival of the second beacon signals at the second locators.

14. The security system of claim 13, wherein the security tag is configured to receive beacon transmissions in the first mode and is configured to transmit beacon signals in the second mode.

15. The security system of claim 13, wherein the security tag is configured to transmit the second beacon signals to the second locator devices at a first rate in the first mode, and wherein the security tag is configured to transmit the second beacon signals to the second locator devices at a second rate in the second mode.

16. The security system of claim 9, wherein the tag controller is configured to lookup current security tag location in a location table and determine whether the mode switch criteria are met based on a correlation between predefined areas and a corresponding operational mode.

* * * * *